United States Patent [19]

Knauer et al.

[11] Patent Number: 4,827,186

[45] Date of Patent: May 2, 1989

[54] ALTERNATING CURRENT PLASMA DISPLAY PANEL

[75] Inventors: Paul E. Knauer, Syracuse; Ronald D. Cleven, Leo, both of Ind.

[73] Assignee: Magnavox Government and Industrial Electronics Company, Fort Wayne, Ind.

[21] Appl. No.: 28,127

[22] Filed: Mar. 19, 1987

[51] Int. Cl.[4] ..... H01J 17/49; H01J 61/35; H01J 61/42

[52] U.S. Cl. ..... 313/485; 313/114; 313/486; 313/487

[58] Field of Search ..... 313/586, 587, 485, 114

[56] References Cited

U.S. PATENT DOCUMENTS

| | | | |
|---|---|---|---|
| 3,290,539 | 12/1966 | Lamorte | 313/114 |
| 3,678,322 | 7/1972 | Souri | 313/201 |
| 3,716,742 | 2/1973 | Nakayama et al. | 313/182 |
| 3,869,630 | 3/1975 | Maio | 313/188 |
| 3,896,327 | 7/1975 | Schermerhorn | 313/485 |
| 3,916,393 | 10/1975 | Criscimagna et al. | 340/173 |
| 3,935,494 | 1/1976 | Dick et al. | 313/190 |
| 3,953,756 | 4/1978 | Monfroy et al. | 313/220 |
| 4,091,305 | 5/1978 | Poley et al. | 313/220 |
| 4,162,427 | 7/1979 | Kamegaya et al. | 315/169 |
| 4,233,623 | 11/1980 | Pavliscak | 358/59 |
| 4,518,894 | 5/1985 | Andreadakis | 313/491 |
| 4,628,422 | 12/1986 | Ewald | 313/114 X |

*Primary Examiner*—Palmer C. DeMeo

*Attorney, Agent, or Firm*—Roger M. Rickert; Thomas A. Briody; Richard T. Seeger

[57] ABSTRACT

Improvements in alternating current plasma display panels are disclosed including an imperforate intermediate structure in such a panel which provides both the function of a separator between the front and back plates (layers or structures) of the panel and the function of cross talk reducing barriers between cells of the panel. The structure includes spacing bosses which extend from the barrier structure and engage the front transparent dielectric plate, and sidewall portions intermediate adjacent pairs of spacing bosses which are separated somewhat from the front dielectric plate to provide a gas and ion passing gap between adjacent cells. In one preferred form, the sidewalls blend into a generally flat bottom wall within each cell. The sidewalls and bottom wall have a smooth or specular surface and may be coated with a reflective material to enhance cell brightness.

23 Claims, 2 Drawing Sheets

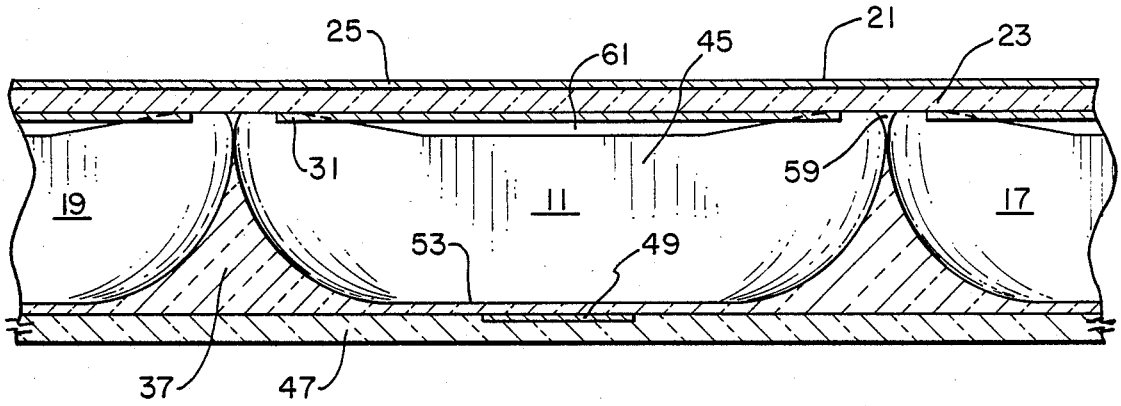
FIG. 3
| | | | | |
|---|---|---|---|---|
| B | G | R | B | G |
| G | R | B | G | |
| R | B | G | R | |
| G | R | B | G | |
| B | G | R | B | |
| G | R | B | G | |
| R | B | G | | |
FIG. 4
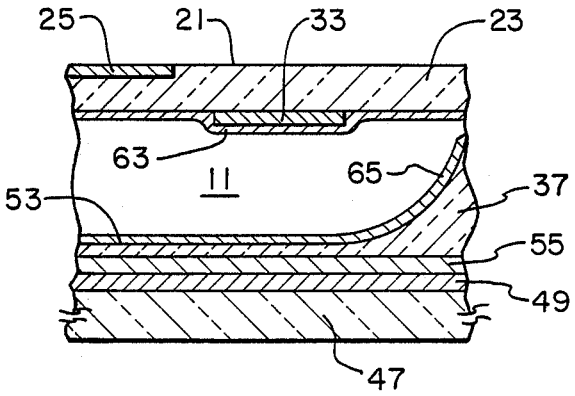
FIG. 5

ALTERNATING CURRENT PLASMA DISPLAY PANEL

SUMMARY OF THE INVENTION

The present invention relates generally to plasma display devices where ultraviolet light from a localized gas discharge excites phosphor materials in discrete locations to create visible dots or pixels, the aggregate of which creates a picture, and more particularly to improvements in such display devices for facilitating assembly thereof, reducing crosstalk between pixels, and providing good resolution and high purity color images.

There is a great deal of interest in plasma display panels because such display devices consume far less space in the direction normal to the plane of the picture as compared to conventional cathode ray tubes. While the use of cathode ray tubes as display devices is quite widespread, they suffer from a number of other defects or undesirable features. Cathode ray tubes have a poor small area contrast ratio due to light scattering and further phenomenon called "halo." When an electron beam impinges on a phosphor surface, that surface radiates light forward toward an observer, but light is also radiated inwardly, reflected and radiates back outwardly to form a bright donut or halo spaced around the central spot. This effectively enlarges the visible spot with consequent loss of perceived detail. Present day plasma display technology has somewhat similar problems which reduce resolution.

The basic theory of operation of alternating current plasma displays may be found in a number of sources such as U.S. Pat. Nos. 3,559,190; 3,935,494; and 4,233,623 as well as the article by T. N. Criscimagna and P. Pleshko entitled AC PLASMA DISPLAY found in topics in Applied Physics, Vol. 40, Published by Springer Verlag in 1980.

Briefly, such display devices have a plurality of gas discharge cells arranged in a generally flat matrix, and first and second sets of spaced apart electrodes with each cell located intermediate one electrode of the first set and one electrode of the second set. The display panel is formed with a first generally flat dielectric plate having the first set of electrodes therein, a second generally flat dielectric plate having the second set of electrodes therein, and with the two plates sealed together about their common periphery to enclose a gas such as a neon-argon mixture. Phosphors responsive to ultraviolet radiation created by a discharge in a cell through the enclosed gas are coated on the one of the two plates through which the display is viewed or the selected gas may be one such as a neon-xenon mixture which has significant radiation in the visible spectrum in which case the phosphors may be eliminated.

In such known display devices, a gas discharge in one cell may energize the phosphors associated with one or more adjacent cells resulting in a larger than desired basic picture element and a resultant loss of color purity. Attempts have been made to eliminate this "crosstalk" between adjacent cells by providing an intermediate layer in the form of a perforated plate having individual holes corresponding to individual cells. This attempt creates problems in evacuating the display device and refilling it with the desired gas and further eliminates the desirable phenomenon of "priming" wherein some intercellular photon or charged particle migration reduces the voltage necessary to fire or energize a cell. Further attempts to isolate cells and eliminate crosstalk while retaining the priming feature and allowing charging of the display device with the proper gas mixture have included a zigzag pattern of passageways between cells (U.S. Pat. No. 3,869,630); and an orthogonal array of grooves or troughs (U.S. Pat. No. 3,953,756).

In addressing these problems, the presently preferred embodiment teaches an alternating current color plasma display which provides enhanced colorimetry over the conventional shadow mask color cathode ray tube. Enclosing each pixel within a barrier surround provides better small and medium area color purity and contrast. Large area color purity is also enhanced due to reduced light scattering within the faceplate.

Current plasma display devices employ glass or metalic spacers between the front and rear plates of the display which are sufficiently large so as to be visible at normal viewing distances from the front viewing plate. With the present invention, these spacers are replaced by much smaller and more numerous corners of the cell barrier structure. This not only eliminates the visible posts, but allows the use of thinner front and back plates. The amount of light scattering within a faceplate is determined by the thickness of the faceplate and the number of bounces or internal reflections between surfaces of that faceplate before total absorption occurs. There are numerous advantages in reduced faceplate thickness including an improvement in large area contrast ratio because of less light scattering, enhanced brightness and large area color saturation, and reduced overall weight of the display.

Among the several objects of the present invention may be noted the provision of an alternating current gas discharge display panel wherein individual cells are isolated to prevent crosstalk yet coupled for priming and charging; the provision of a display device which allows the use of thinner than heretofor possible dielectric substrates and, due to the small amount of glass between substrates, reduced capacitances and lowered firing voltages; the provision of a display device which uses current technology where possible and departs therefrom primarily in the fabrication of a barrier and separator layer between the currently used front and back dielectric layers; and the provision of an overall improved color plasma display device.

While one objective is to provide a barrier structure around pixels which to a large extent isolates a particular pixel from all others in the plasma display, some openings should be left in order to allow free gas flow into the cell or pixel area along with ionizing particles which aid firing of the cell at relatively low voltages. This has a stabilizing effect on cell operation. A further objective is to produce a structure that does not have much glass or other dielectric material in the plasma gap between electrodes, since such glass increases the gap capacity and effectively raises the firing voltage and current. These as well as other objects and advantages features of the present invention will be in part apparent and in part pointed out hereinafter.

In general, an alternating current gas discharge display panel has a plurality of gas discharge cells arranged in a generally flat matrix, and first and second sets of spaced apart electrodes with each cell located intermediate one electrode of the first set and one electrode of the second set. An intercell barrier structure is formed as an imperforate layer of dielectric material intermediate the first and second sets of electrodes and extends substantially throughout the matrix, the layer having a plurality of concavities in one face thereof each associated with a unique cell.

Also in general and in one form of the invention, an alternating current gas discharge display panel has a plurality of gas discharge cells arranged in a generally flat matrix, and electrodes for selectively inducing and inhibiting gas discharge within selected cells. The display panel is formed with a first generally flat dielectric plate having the first set of electrodes therein, a second generally flat dielectric plate having the second set of electrodes therein. An intercell barrier structure provides a uniform separation between the first and second dielectric plates. The intercell barrier structure is formed as an imperforate layer of dielectric material intermediate the first and second sets of electrodes and extends substantially throughout the matrix, the layer having a plurality of concavities in one face thereof each associated with a unique cell.

Still further in general, and in one form of the invention, an alternating current gas discharge display panel has a plurality of gas discharge cells arranged in a generally flat matrix, having a generally planar front viewing surface, and comprises in sequence. The viewing surface; a front transparent dielectric layer including a first set of generally parallel spaced apart conductors thereon; fluorescent material areas disposed on the surface of the front dielectric plate opposite the front viewing surface; a barrier defining and plate separating member having a number of upstanding posts engaging the surface of the front structure opposite the front viewing surface, and sidewall portions intermediate adjacent pairs of posts which is spaced from the surface of the front dielectric layer opposite the front viewing surface to provide gas and photon or charged particle passing gaps; and a rear dielectric layer covering a second set of generally parallel spaced apart conductors, the second set of conductors extending generally orthogonal to the first set of conductors.

BRIEF DESCRIPTION OF THE DRAWING

FIG. 3 is a view in cross-section along lines 3—3 of FIG. 1;

FIG. 4 illustrates a nesting chevron pattern for red, green and blue phosphors to provide a color display; and FIG. 5 is an enlarged cross-sectional view of a portion of FIG. 2 showing the several layers in greater detail.

Corresponding reference characters indicate corresponding parts throughout the several views of the drawings.

Figure 1:
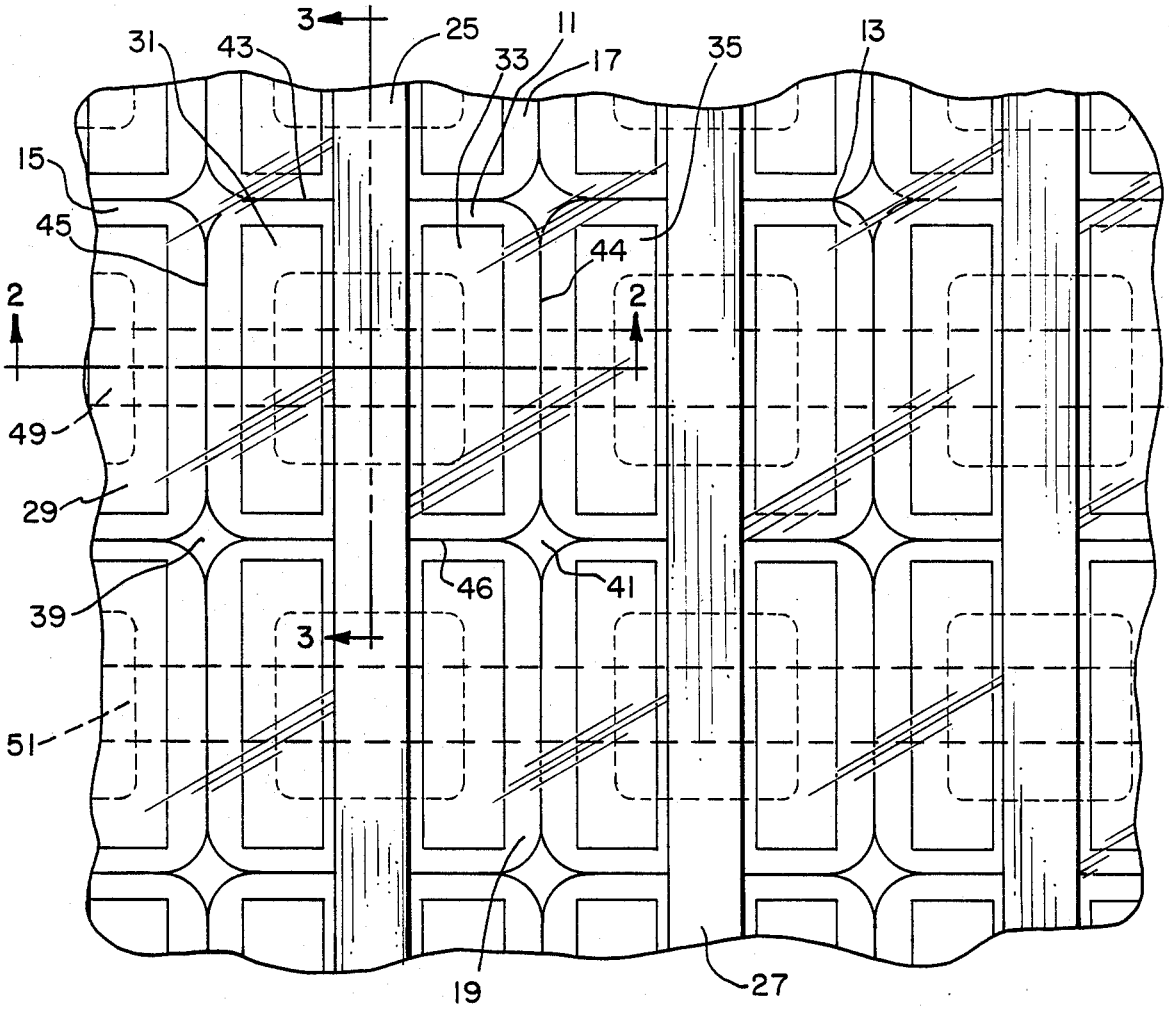
FIG. 1 is a front elevation view of a portion of a display panel incorporating the present invention in one form.

The exemplifications set out herein illustrate a preferred embodiment of the invention in one form thereof and such exemplifications are not to be construed as limiting the scope of the disclosure or the scope of the invention in any manner.

DESCRIPTION OF THE PREFERRED EMBODIMENT

An alternating current gas discharge display panel is illustrated in the first three views of the drawing as having a plurality of gas discharge cells such as 11, 13, 15, 17, and 19 arranged in a generally flat matrix and having a generally planar front viewing surface 21. The display panel comprises in sequence from the viewing surface (not shown): a front transparent dielectric layer 23 including a first set of generally parallel spaced apart conductors such as 25 and 27; fluorescent material areas or islands such as 29, 31, 33, and 35 disposed on the surface of the front dielectric plate 23 opposite the front viewing surface 21; a barrier defining and plate separating member 37 having a number of upstanding posts such as 39 and 41 engaging the surface of the front dielectric layer 23 opposite the front viewing surface, and sidewall portions such as 43 and 45 intermediate adjacent pairs of posts which are spaced (actually contoured somewhat like a saddle) from the surface of the front dielectric plate opposite the front viewing surface to provide gas and ion passing gaps 59 and 61; and a rear dielectric plate 47 including a second set of generally parallel spaced apart conductors such as 49 and 51. The second set of conductors 49 and 51 extend generally orthogonal to the first set of conductors 25 and 27.

Figure 2:
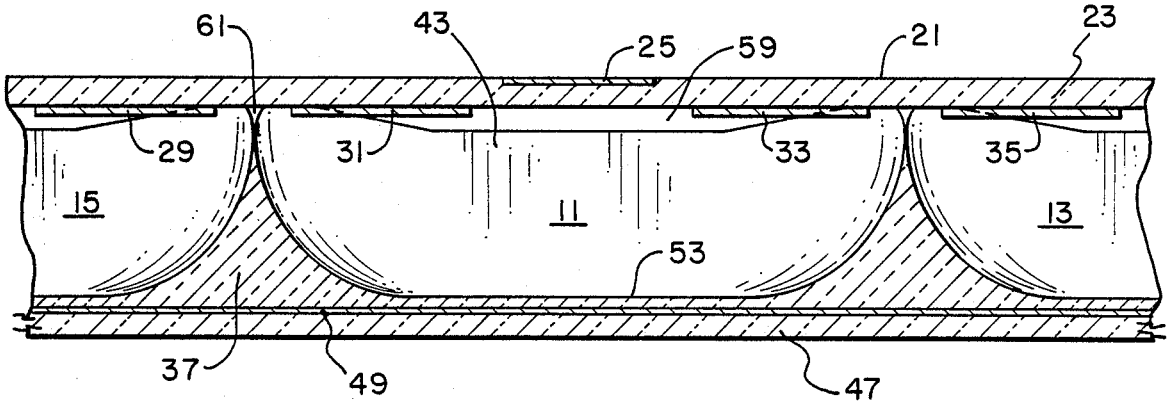
FIG. 2 is a view in cross-section along lines 2—2 of FIG. 1.

In FIGS. 2 and 3, it will be noted that each cell, 11 for example, is located intermediate one conductor (25) of the first set and one conductor (49) of the second set. The sidewall portions define a plurality of concavities, one for each cell. For example, cell 11 is associated with the concavity defined by the sidewalls 43, 44, 45, and 46. Each concavity includes a generally flat central surface portion 53 parallel to the front viewing surface 21 and curved sidewall surface portions 43, 44, 45, and 46 blending with the flat central portion surface 53. Furthermore, each concavity has a smooth or specular inner surface which may optionally be made diffusely reflective by adhesive application of a white powder to redirect both visible and ultraviolet radiation back toward the front dielectric plate.

Basic alternating current plasma cell operation and addressing is well documented in the earlier referenced patents and literature. Briefly, such a cell electrically looks like three capacitors in series with the drive voltage (voltage between electrodes 25 and 49 for example) with the central capacitance being the gas filled gap before firing while the outer capacitors are the dielectric walls of the cell. When the voltage across the gap exceeds a predetermined threshold, the gas discharge occurs and on each successive half cycle the discharge again occurs and on each successive half cycle the discharge again occurs even if the applied voltage is reduced to a so called sustain level. Further reduction of the applied voltage results in the discharge being extinguished. Thus a sustain voltage may be applied to all cells without any of them discharging, one additional voltage pulse superimposed on a half cycle of the sustain voltage for a given cell as selected by one of each of the electrode sets to discharge the selected cell and that selected cell will remain on until a subtractive pulse or voltage is introduced along with the sustain voltage to extinguish the selected cell.

Formation of the intercell barrier structure or plate 37 is acomplished by chemical milling techniques similar to those employed in making printed circuit boards, integrated circuits, and in some cases certain of the prior art display components. In the formation of the barrier plate, the following parameters should be considered.

Display fabrication includes a high vacuum evacuation of the panel and the footprint or top of the posts such as 39 and 41 must be sufficiently large so as to adequately support the front faceplate and not crush under this high vacuum condition. A post size of about two one-thousandths of an inch on a side has been found suitable. This allocates about 1.4 percent of the picture area to the post footprints, well below the visible threshold under normal viewing conditions. Such small posts also allow the phosphor islands such as 31 and 33 to be bigger, thus increasing the brightness of the display.

The chemical milling process determines the knife-edge barrier sidewalls such as 43 and 45 between adjacent posts known as the saddle. The depth from the top of the posts to the saddle (and hence the gap between the inner surface of faceplate 23 and the upper edge of sidewall 43 or 45 when the panel is completed) should be about 0.7 one-thousandths of an inch (0.7 mils). A lesser gap does not allow adequate gas flow during processing or assembly of the panel and also restricts the flow of priming particles through the panel and between pixel cells which flow stabilizes the cell firing voltage. If no flow exists, the firing voltage is much higher and not consistent from pixel to pixel. If the saddle depth is too great, ultraviolet radiation from the discharge in one cell will be transmitted through the gap to phosphors in adjacent cells resulting in color desaturation. The height of a phosphor island such as 31 is about $\frac{2}{3}$ mils and contributes significantly to radiation blocking in the saddle region.

The chemical milling process also determines the trough depth or distance between the inner face of plate 23 and the flat bottom surface 53. This trough depth or gap is important since it effects the firing voltage of the cell and if the depth is not consistent throughout the panel, different cells will fire at different voltages rendering proper control of firing and sustain voltages difficult or impossible. Here again the close spacing of the small cell corner posts represents an improvement over prior devices since any sag or deflection of the faceplate 23 and associated gap variation is virtually eliminated.

Panel fabrication may begin with a substrate or back panel 47 of a soda lime float plate glass to which a thin film of tantalum and then a thin film of gold are applied by an electron beam vacuum deposition process. The tantalum improves the adhesion of the gold to the glass. A resist material is then applied and selectively exposed and developed and an etchant used to remove the gold in all places except for the desired conductors such as 49. Thick film conductor contact pads may then be applied by silk screening if desired. After the remaining resist is stripped away, a layer of lead borosilicate glass 55 (FIG. 5) about one mil thick is screened on and reflowed to form a smooth surface. Layer 55 may include a dye so that the subsequent chemical milling process may be stopped at the appropriate time when this dye is visible. A second layer 37 of this same or a similar glass is scrrened on the active display area and after firing provides a layer of the desired gap thickness ready for chemical milling.

Another resist layer is applied and exposed through a mask having generally square patterns centered over each pixel location. These square patterns are substantially the same size as the flat bottom portion 53 of a completed cell. When the resist is developed, square etchant passing openings are centered over the cells.

As a first approximation, a chemical milling process progresses much the same as a wave propogates linearly with time in all directions so if the desired depth of the trough is 4.7 mils and no saddle is desired, the distance from the square resist opening to the knife edge of sidewalls such as 45 would also be 4.7 mils. A slight enlargement of the square resist opening beyond the trough depth results in the desired sag between surface of faceplate 23 and the sidewalls.

The process of placing the pattern of conductors 25 on the faceplate 23 is much the same as that for the conductors 49 on rear plate 47. The phosphor islands such as 33 and 35 are next applied. The phosphors may lie in continuous strips across the inner surface of faceplate 23 in a monochrome display, or may be applied in three steps along the chevron or zigzag patterns of FIG. 4 in the case of a color display. In the latter case, the mask for each of the three color phosphors is the same except for lateral displacement by one or two cell widths. The phosphors should have a high efficiency when excited by ultraviolet light with typical examples being: $(Y,Gd)BO_3:Eu^{3+}$for red; $BaMgAl_{14}O_{23}:Eu^{2+}$ for blue; and $BaAl_{12}O_{19}$:Mn for green in the color display.

The inner surface of faceplate 23 is coated with resist, exposed through a mask by near contact printing, developed with water, and phosphor particles are blown into the remaining island pattern damp resist. In the color case these steps are repeated for each of the three colors with drying in between. The resist is then pyrolized by an oven bake.

A diffuse white reflective layer 65 may next be applied to the cells. One technique is to mix a magnesium oxide powder and a photo resist material, apply the mixture to the cells and expose the photo resist material from the back side of the panel. After development, this leaves the white surface throughout the cells except for over the electrodes where exposure was blocked by the electrodes.

An emissive layer 63 such as Magnesium oxide is next applied to the phosphor islands and to the barrier structure by electron beam thin film deposition. In the case of the barrier structure, the emissive layer goes over layer 65 which still provides a white diffuse reflective surface which turns ultraviolet radiation back toward the phosphor islands. The emissive layer protects the phosphor surfaces from damage caused by plasma electron and ion bombardment.

Sealing of the panel perimeter is accomplished by a frit glass having a lower melting point than the dielectric plates. This frit glass is formed as a rectangular border beyond the active display area, the plates are aligned and sealed by a long bake cycle.

Finally, the sealed panel is heated and evacuated for a period of time to eliminate contaminants and then backfilled with the desired gas before final sealing.

From the foregoing, it is now apparent that a novel display arrangement has been disclosed meeting the objects and advantageous features set out hereinbefore as well as others, and that numerous modifications as to the precise shapes, configurations and details may be made by those having ordinary skill in the art without departing from the spirit of the invention or the scope thereof as set out by the claims which follow.

What is claimed is:

1. In an alternating current gas discharge display panel having a plurality of gas discharge cells arranged in a generally flat matrix, and first and second sets of spaced apart electrodes with each cell located intermediate one electrode of the first set and one electrode of the second set, the improvement comprising an intercell barrier structure formed as an imperforate layer of dielectric material intermediate the first and second sets of electrodes and extending substantially throughout the matrix, the imperforate layer having a plurality of concavities in one face thereof, each of said concavities being associated with a unique cell, the display panel being formed with a first generally flat dielectric layer having the first set of electrodes therein, a second generally flat dielectric layer having the second set of electrodes therein, and the intercell barrier structure providing a uniform separation between the first and second dielectric layers.

2. The improvement of claim 1 wherein the first dielectric layer is transparent, the barrier structure concavities opening toward the first dielectric layer.

3. The improvement of claim 2 wherein each barrier structure concavity is bounded by a number of spacers which engage the first dielectric layer.

4. The improvement of claim 3 wherein each barrier structure concavity includes at least one sidewall portion intermediate a pair of spacers which is separated from the first dielectric layer to provide a priming particle passing gap between adjacent cells.

5. The improvement of claim 2 wherein each barrier structure concavity is provided with a reflective surface for directing incident radiation toward the first dielectric layer.

6. The improvement of claim 5 further comprising layers of fluorescent material on the first dielectric layer, there being at least one fluorescent material layer in each cell.

7. The improvement of claim 6 wherein there are at least three dissimilar fluorescent materials which fluoresce in dissimilar colors no two layers of which share a common cell and each of which is adjacent at least one cell containing a layer of a different one of the materials.

8. In an alternating current gas discharge display panel having a plurality of gas discharge cells arranged in a generally flat matrix, and first and second sets of electrodes for selectively inducing and inhibiting gas discharge within selected cells, the improvement comprising an intercell barrier structure formed as an imperforate layer of dielectric material intermediate the first and second sets of electrodes and extending substantially throughout the matrix, the imperforate layer having a plurality of concavities in one face thereof each associated with a unique cell, the electrodes comprising first and second sets of spaced apart electrodes with each cell located intermediate one electrode of the first set and one electrode of the second set, the electrode sets disposed in generally parallel spaced apart planes and extending linearly generally orthogonal to one another, the display panel being formed with a first generally flat dielectric layer having the first set of electrodes therein, a second generally flat dielectric layer having the second set of electrodes therein, and the intercell barrier structure providing a uniform separation between the first and second dielectric layers.

9. The improvement of claim 8 wherein the first dielectric layer is transparent, the barrier structure concavities opening toward the first dielectric layer.

10. The improvement of claim 9 wherein each barrier structure concavity is bounded by a number of dielectric layer spacing bosses which extend from the barrier structure and engage the first dielectric layer.

11. The improvement of claim 10 wherein each barrier structure concavity includes at least one sidewall portion intermediate a pair of spacing bosses which is separated from the first dielectric layer to provide priming particle passing gap between adjacent cells.

12. The improvement of claim 8 wherein each barrier structure concavity is provided with a reflective surface for directing incident radiation toward the first dielectric layer.

13. The improvement of claim 12 further comprising layers of fluorescent material on the first dielectric layer, there being at least one fluorescent material layer in each cell.

14. The improvement of claim 13 wherein there are at least three dissimilar fluorescent materials which fluoresce in dissimilar colors no two layers of which share a common cell and each of which is adjacent at least one cell containing a layer of a different one of the materials.

15. The improvements of claim 8 wherein each barrier structure concavity includes a generally flat central surface portion and curved sidewall surface portions blending with the flat central portion surface.

16. The improvement of claim 8 wherein each barrier structure concavity has a specular inner surface.

17. An alternating current gas discharge display panel having a plurality of gas discharge cells arranged in a generally flat matrix, having a generally planar front viewing surface, and comprising in sequence from the viewing surface;

a front transparent dielectric structure including a first set of generally parallel spaced apart conductors;

fluorescent material areas disposed on the surface of the front dielectric structure opposite the front viewing surface;

a barrier defining and structure separating member having a number of upstanding posts engaging the surface of the front dielectric structure opposite the front viewing surface, and sidewall portions intermediate adjacent pairs of posts which are spaced from the surface of the front dielectric structure opposite the front viewing surface to provide priming particle passing gaps; and a rear dielectric structure including a second set of generally parallel spaced apart conductors, the second set of conductors extending generally orthogonal to the first set of conductors.

18. The improvement of claim 17 wherein each cell is located intermediate one conductor of the first set and one conductor of the second set.

19. The improvement of claim 17 wherein the sidewall portions define a plurality of concavities, one for each cell, and each concavity is provided with a reflective surface for directing incident radiation toward the front transparent dielectric structure.

20. The improvement of claim 17 wherein the sidewall portions define a plurality of concavities, one for each cell, and each concavity includes a generally flat central surface portion parallel to the front viewing surface and curved sidewall surface portions blending with the flat central portion surface.

21. The improvement of claim 17 wherein the sidewall portions define a plurality of concavities, one for each cell, and each concavity has a specular inner surface.

22. The improvement of claim 17 wherein the sidewall portions define a plurality of concavities, one for each cell, and each concavity has a surface made diffusely reflective by adhesive application of a white powder to redirect both visible and ultraviolet radiation back toward the front dielectric structure.

23. The improvement of claim 17 wherein the rear dielectric structure is formed to include a dye so that chemical milling during panel fabrication may be stopped at the appropriate time when this dye is visible.

* * * * *